US008240450B2

(12) United States Patent
Brexel et al.

(10) Patent No.: US 8,240,450 B2
(45) Date of Patent: Aug. 14, 2012

(54) APPARATUS AND METHOD FOR DEPOSITING AND/OR DISPENSING AT LEAST BANKNOTES HAVING A FIRST DENOMINATION AND BANKNOTES HAVING A SECOND DENOMINATION

(75) Inventors: Dirk Brexel, Geseke (DE); Achim Schmidtmann, Paderborn (DE)

(73) Assignee: Wincor Nixdorf International GmbH (DE)

( * ) Notice: Subject to any disclaimer, the term of this patent is extended or adjusted under 35 U.S.C. 154(b) by 44 days.

(21) Appl. No.: 12/603,832

(22) Filed: Oct. 22, 2009

(65) Prior Publication Data

US 2010/0198396 A1 Aug. 5, 2010

(30) Foreign Application Priority Data

Jan. 30, 2009 (DE) ..... 10 2009 006 810

(51) Int. Cl.
*G07F 7/04* (2006.01)

(52) U.S. Cl. ..... 194/206

(58) Field of Classification Search ..... 194/206, 194/205, 215; 235/379; 902/9, 12, 13, 14, 902/15, 40; 209/534
See application file for complete search history.

(56) References Cited

U.S. PATENT DOCUMENTS

| | | | | |
|---|---|---|---|---|
| 4,185,646 | A * | 1/1980 | Woods et al. | 221/93 |
| 5,105,364 | A * | 4/1992 | Kawamura et al. | 700/219 |
| 6,000,555 | A * | 12/1999 | Anma | 209/534 |
| 6,896,116 | B2 * | 5/2005 | Deaville et al. | 194/206 |
| 7,278,527 | B2 * | 10/2007 | Daout et al. | 194/206 |
| 7,441,695 | B1 * | 10/2008 | Saltsov et al. | 232/1 D |
| 2004/0245066 | A1 * | 12/2004 | Ichikawa et al. | 194/206 |
| 2008/0061127 | A1 | 3/2008 | Brexel | |
| 2009/0229947 | A1 * | 9/2009 | Takai et al. | 194/206 |
| 2010/0211437 | A1 | 8/2010 | Schneider et al. | |
| 2011/0031308 | A1 | 2/2011 | Holland-Letz et al. | |

FOREIGN PATENT DOCUMENTS

| | | | |
|---|---|---|---|
| DE | 69108641 | T2 | 9/1995 |
| DE | 10 2004 061 467 | | 12/2004 |
| DE | 10 2007 023 598 | | 11/2008 |
| DE | 10 2008 018 964 | | 3/2009 |
| DE | 10 2008 018 935 | | 10/2009 |
| EP | 0 473 106 | | 3/1992 |
| EP | 0.473.106 | A2 * | 3/1992 |
| EP | 1 326 215 | | 7/2003 |
| WO | 01-91065 | | 11/2001 |
| WO | 2006-063555 | | 6/2006 |

* cited by examiner

*Primary Examiner* — Mark Beauchaine
(74) *Attorney, Agent, or Firm* — Harness, Dickey & Pierce, P.L.C.

(57) ABSTRACT

The invention relates to an apparatus (8) for depositing and/or dispensing at least banknotes (13) of a first denomination and banknotes (13) of a second denomination having at least one input and/or output unit (22) for the input of the banknotes (13) to be deposited and/or the output of the banknotes (13) to be dispensed. The apparatus (8) further comprises a reading unit (26) with the aid of which at least the denomination of each banknote (13) to be deposited or dispensed can be ascertained. Furthermore, at least one banknote acceptor (12*a* to 12*d*) to accept the banknotes (13) is provided. In addition, the apparatus has at least one transport unit to transport banknotes (13) between the input and output unit (22) and the banknote acceptor (12*a* to 12*d*), wherein the transport unit of the banknote acceptor (12*a* to 12*d*) supplies only banknotes (13) of the first denomination and banknotes (13) of the second denomination to the banknote acceptor (12*a* to 12*d*).

12 Claims, 4 Drawing Sheets

APPARATUS AND METHOD FOR DEPOSITING AND/OR DISPENSING AT LEAST BANKNOTES HAVING A FIRST DENOMINATION AND BANKNOTES HAVING A SECOND DENOMINATION

BACKGROUND OF THE INVENTION

Technical Field

The invention relates to an apparatus for depositing and/or dispensing at least banknotes having a first denomination and banknotes having a second denomination. The apparatus comprises at least one input and/or output unit to input the banknotes to be deposited and/or to output the banknotes to be dispensed. The apparatus further has a reading unit, with the aid of which at least the denomination of each banknote to be deposited or to be dispensed can be ascertained, and at least one banknote acceptor to receive the banknotes. Furthermore, a transport unit is provided to transport banknotes between the input and/or output unit and the banknote acceptor. The invention further relates to a method for handling at least banknotes having a first denomination and banknotes having a second denomination.

The apparatus and the method are used specifically in automated teller machines, preferably in deposit and dispensing teller machines. In the case of deposit and dispensing teller machines, also described as automated money recycling machines, banknotes can both be deposited by an operator as well dispensed to the operator. In the case of a deposit, the banknotes to be deposited are input by the operator into an input and/or output drawer as a bundle. The deposited banknotes in the bundle are taken after singulation to a reading unit with the aid of which the genuineness of the banknotes deposited, and, additionally, the denomination of each individually fed in banknote are ascertained. The banknotes are then taken to money cassettes for storage. For this purpose, the automated teller machine comprises a plurality of money cassettes, where the number of money cassettes depends specifically on the number of different denominations of banknotes that are in circulation. The automated money recycling teller has a deposit cassette in which those banknotes are received that are suspected of being counterfeit and those banknotes that are not to be dispensed again because of their denomination. In the eurozone, these are specifically banknotes with a denomination of 200 euros and 500 euros. A separate money cassette is provided for every other denomination respectively. If only 200 euro and 500 euro banknotes are taken to the deposit cassette, five additional money cassettes must be provided, namely a money cassette for the 5 euro notes, a money cassette for the 10 euro notes, a money cassette for the 20 euro notes, a money cassette for the 50 euro notes, a money cassette for the 100 euro notes. Storage of banknotes where only notes of one denomination are stored in a money cassette, is also known as single-item storage. In the case of an automated money recycling teller, those money cassettes at least in which banknotes intended for dispensing are stored are configured in such a way that the banknotes can be removed from the money cassette again.

For a withdrawal, the desired sum to be dispensed is entered by an operator with the aid of an input unit of a human-machine interface on the automated money recycling teller. Depending on the desired amount to be dispensed, the mix of denominations in the bundle to be dispensed is ascertained. The mix of denominations in a bundle to be dispensed can be preset as a function of the withdrawal amount entered or be freely selected by the operator. The banknotes to be dispensed are taken from the respective money cassettes and, with the aid of a transport unit, taken to the input-and-output drawer where the banknotes to be dispensed are issued to the operator. The disadvantage of the single-item storage described is that at least one money cassette must be provided respectively for each denomination of banknote that may have to be dispensed. The result is a large number of requisite money cassettes, which prevents compact construction of the automated money recycling machine, or at least makes it more difficult, which in turn leads to high costs. Alternatively, the number of denominations of banknotes for dispensing must be reduced.

A single-sheet handling apparatus for the input and/or output of at least a single sheet into or from a container is known from the not previously published document DE 10 2008 018 964. The single-sheet handling apparatus has an impeller that has at least one vane. The vane presses at least one part of the single sheets disposed in a stack in the container into the container when the vane contacts the end face of the stack and holds these individual sheets in a standing position in the container.

An apparatus and a method for ascertaining a contact point in time for contacting a money transfer system is known from document DE 10 2007 023 598 A1. The apparatus comprises a data processing system to which data can be supplied with information about the time line of the need to transfer out funds to the system and/or about the time line of the need to withdraw funds from the system. Starting with the time line for the need, the data processing system determines at least one next point in time at which the money system will have a need to transfer funds in and/or transfer funds out.

A sheet handling apparatus is known from document EP 0 473 106 B1 with reading means to read characteristic information concerning the sheets processed, control means to control operation of the apparatus, and storage means to store the characteristics of the sheets read by the reading means in the sequence in which the sheets are received in a collecting section of the apparatus. The sheet handling apparatus further comprises setting means to set one part of the characteristics that are to be stored in the storage means, and for setting a step value for selecting the sheets, and for storing the characteristics read.

A bill receiving and paying device and automated cash transaction apparatus are known from document EP 1 326 215 A2 in which banknotes of different sizes can be input, stored together and output again. The bill receiving and paying device comprises a storage unit in which banknotes of different sizes can be stored in an intermixed state and discharged.

SUMMARY OF THE INVENTION

The object of the invention is to propose an apparatus for depositing and/or dispensing at least banknotes of a first denomination and banknotes of a second denomination that is compact and cost-effective to construct. It is a further object of the invention to cite an apparatus and a method for depositing or dispensing at least banknotes of a first denomination and banknotes of a second denomination, by which the banknotes to be deposited and/or dispensed can be deposited or dispensed in a short time.

In accordance with the invention, the apparatus for depositing and/or dispensing at least banknotes of a first denomination and banknotes of a second denomination comprises at least an input and/or output unit to input banknotes to be deposited and/or to output banknotes to be dispensed. The apparatus further has a reading unit with the aid of which at least the denomination of each banknote to be deposited or dispensed can be ascertained. Furthermore, a banknote acceptor for accepting the banknotes and at least one transport unit for transporting banknotes between the input and/or output unit and the banknote acceptor are provided. The transport unit takes only banknotes of the first denomination and banknotes of the second denomination to the banknote acceptor. Accepting banknotes of two different denominations in one banknote acceptor is also described as mixed storage. The number of banknote acceptors can be reduced as a result of mixed storage, allowing the apparatus to be of a compact, space-saving construction and in turn reducing the resulting costs.

By storing banknotes of only two different nominations in one banknote acceptor, only a few banknotes have to be transported into interim storage when banknotes are dispensed because a banknote needed for dispensing is located behind the banknotes buffered in interim storage in the sequence in which the banknotes can be taken from the acceptor. This reduces the time needed to dispense the sum of money requested to a person operating the apparatus.

In an advantageous aspect of the invention, at least two banknote acceptors, specifically three or four banknote units, are provided. This makes it possible for at least banknotes having a relatively large number of different denominations to be deposited in the apparatus and dispensed by the apparatus. The banknote acceptors are specifically money cassettes. Alternatively, thin-walled transport containers, specifically bags made of film material or woven material, can be used.

The apparatus is preferably configured in such a way that banknotes can both be deposited as well as dispensed. An apparatus of this kind is, for example, an automated money recycling machine or an automated strong box. The input unit to input the banknotes to be deposited and the output unit to output one of the banknotes to be dispensed are preferably configured in one piece, and it is described hereinafter as input-and-output unit.

It is advantageous if the banknote acceptor comprises at least one machine-readable and machine-writeable non-volatile memory, such as an EEPROM, in which at least data containing information about the denominations of all banknotes accepted in the banknote acceptor and data containing information about the sequence in which the banknotes are disposed in the banknote acceptor are stored. If the apparatus comprises several banknote acceptors, it is advantageous if each of these banknote acceptors respectively comprises at least one memory element in which the above named data are stored. Complete inventory management is possible by knowing the denominations of all the banknotes accepted in the banknote acceptor and by knowing the sequence in which the banknotes are disposed in the banknote acceptor. In this way, a potential, preferably the optimal, composition of a bundle of vouchers to be dispensed can be ascertained even before the first banknote is removed from a banknote acceptor when banknotes of different denominations are stored in a banknote acceptor. Further, attempts at manipulation and double draw-offs can easily be detected by complete inventory management. Locating at least one memory element in each banknote acceptor makes it possible for the data saved in the memories of the memory elements to remain intact even when the banknote acceptor is removed from the apparatus, and the banknote acceptor can thus be taken to another apparatus for depositing and dispensing banknotes, and the data saved in the memory of the banknote acceptor can be read out by this other apparatus. In this way, banknote acceptors in which banknotes of different denominations have been accepted can be exchanged between automated teller machines without the necessity of removing the banknotes accepted in the banknote acceptor and of providing the banknote acceptors with predetermined single-item storage. In this way, the logistical complexity and the associated costs can be reduced. In addition, the data read out can be verified using centrally stored data on the respective banknote acceptors in order to detect manipulation in particular. The centrally stored data can be stored in a central database.

It is especially advantageous if, in addition, data containing information about the number of banknotes received in the banknote acceptor and/or data containing information about the first denomination and the second denomination of the banknotes that can be accepted in the banknote acceptor are stored in the memory element of the banknote acceptor. In this way, the exchange of the banknote acceptors between automated teller machines is further simplified since the automated teller machine can automatically ascertain the denominations of the banknotes than can be supplied to or removed from the banknote acceptor.

In a preferred embodiment of the invention, a first banknote acceptor, a second banknote acceptor and at least a third banknote acceptor are provided. The transport unit takes only banknotes of the first denomination to the first banknote acceptor, only banknotes of the second denomination and banknotes of a third denomination to the second banknote acceptor, and banknotes of a third denomination and banknotes of a fourth denomination to the third banknote acceptor. What is achieved in this manner is that banknotes of four different denominations can be accepted in only three banknote acceptors. It is particularly advantageous if the first denomination is smaller than the second denomination, the second denomination smaller than the third and the fourth denomination smaller than the third. What is achieved in this way is that banknotes of two adjacent denominations are always accepted in one banknote acceptor. This has the advantage that the banknotes accepted in one banknote acceptor are of a similar size so that said notes can be handled more easily and the risk of multiple draw-offs and/or banknote jams is reduced.

In an alternative embodiment of the invention, the apparatus comprises a first, a second and at least a third banknote acceptor, wherein the transport unit takes only banknotes of the first denomination and banknotes of the second denomination to the first banknote acceptor, only banknotes of the second denomination and banknotes of a third denomination to the second banknote acceptor and only banknotes of the third denomination and banknotes of a fourth denomination to the third banknote acceptor. What this achieves is that the banknotes of the second denomination as well as the banknotes of the third denomination can be taken to two different banknote acceptors, so that when a banknote of the second denomination is deposited, or a banknote of the third denomination is deposited, a selection can be made in which of the two possible banknote acceptors the respective banknote is to be accepted. The assignment of a banknote for deposit of the second denomination to the first banknote acceptor or to the second banknote acceptor, or assignment of a banknote of the third denomination to the second banknote acceptor or to the third banknote acceptor can be managed specifically as a function of the banknotes already accepted by the second or third banknote acceptor.

It is advantageous if each banknote acceptor comprises a first delimiting element and at least a second delimiting element with the aid of which the dimensions of a receiving area for each banknote acceptor can be adjusted such that only banknotes of predetermined denominations can be stacked in order in the banknote acceptor. The delimiting elements are preferably a vertical stop, with which the maximum height of the banknotes receivable in the banknote acceptor is set, and a lateral stop, with which the maximum width of the banknotes that can be brought to the banknote acceptor is set. The maximum height preferably equals the length of the short side of the banknote of the largest denomination that is to be accepted by the banknote acceptor. The maximum width preferably equals the length of the long side of the banknote of the largest denomination that is to be accepted in the respective banknote acceptor.

In this way, what is achieved by the first and second delimiting elements is that no banknotes can be accepted in the banknote acceptor that are of a larger denomination or larger dimensions than the banknote of the largest denomination that is to be accepted in the respective banknote acceptor. Further, the two delimiting elements ensure reliable handling of the banknotes, specifically avoiding multiple draw-offs and/or banknotes jams when introducing banknotes into the banknote acceptor or removing banknotes from the banknote acceptor. When discussing the size of the banknotes of different denominations, it is assumed that the size, i.e. the height and/or width, of banknotes of a smaller denomination decreases, or at least does not increase.

A further aspect of the invention relates to an apparatus for depositing and/or dispensing at least banknotes of a first denomination and banknotes of a second denomination with at least one input and/or output unit for inputting the banknotes to be deposited and/or outputting the banknotes to be dispensed. Further, the apparatus comprises a reading unit with the aid of which at least the denomination of each banknote to be deposited or dispensed can be ascertained. In addition, the apparatus has at least one banknote acceptor for accepting the banknotes and at least one transport unit for transporting banknotes between the input and/or output unit and the banknote acceptor.

The transport unit feeds at least banknotes of the first denomination and of the second denomination to the banknote acceptor, and the banknote acceptor comprises at least one memory element in which at least data are saved with information about the denomination of all banknotes accepted in the banknote acceptor, and data are saved with information about the sequence in which the banknotes are disposed in the banknote acceptor. By storing banknotes of two different denominations, or banknotes of more than two different denominations, in one banknote acceptor, a compact structure for the apparatus is achieved whereby costs for the entire apparatus are reduced. By saving the denominations of all banknotes accepted in the banknote acceptor and the sequence in which the banknotes are arranged, or stacked, in the banknote acceptor, firstly, complete inventory management can be implemented, and secondly, the exchange of banknote acceptors between several apparatuses for the deposit and/or dispensing of banknotes can be achieved without the banknotes having to be removed completely from the banknote acceptor and the banknote acceptor having to be filled with different banknotes.

It is advantageous if the apparatus comprises at least two banknote acceptors, preferably three or four banknote acceptors, and if each of the banknote acceptors comprises respectively at least one memory element.

It is furthermore advantageous if data with information about the number of banknotes accepted in the banknote acceptor and data with information about the first denomination and the second denomination of the banknotes that can be accepted in the banknote acceptor are stored in the memory element of each of the banknote acceptors.

It is advantageous if the reading unit comprises at least one sensor for verifying the genuineness of a supplied banknote, and if the reading unit ascertains at least the denomination of the banknote, and if data are saved in the memory element of that banknote acceptor in which the deposited banknote is stored containing information about the ascertained denomination of a deposited banknote. A compact structure for the apparatus becomes possible because the genuineness as well as the denomination of banknotes deposited can be ascertained with the aid of the reading unit.

In a preferred embodiment of the invention, a fourth banknote acceptor for accepting banknotes that are not intended for dispensing and/or for accepting banknotes that have been prepared in the input and output unit for dispensing to an operator but have not been removed by said operator. The operator is preferably a bank customer. The banknotes that are not intended for dispensing are specifically banknotes of a large denomination. In the eurozone, these are specifically banknotes of 100 euros, 200 euros and 500 euros denomination. What is achieved by accepting these banknotes not intended for dispensing into a separate fourth banknote acceptor is that said notes are not disposed together with those banknotes that are intended for dispensing in one banknote acceptor and thus, at the time banknotes are dispensed, said notes do not first have to be transported into interim storage so that the banknotes intended for dispensing can actually be dispensed. As a result, the speed with which the banknotes to be dispensed are prepared in the input or output unit for the operator is increased.

It is particularly advantageous to provide a fifth banknote acceptor for accepting banknotes that have been classified as suspected counterfeits when their genuineness was verified. What is thereby achieved is that suspect banknotes are kept separately from the other banknotes and can be removed from the apparatus for a closer inspection of their genuineness.

The apparatus preferably encompasses interim storage for the temporary acceptance of banknotes. The interim storage serves specifically to store banknotes temporarily during the banknote deposit and/or dispensing transaction. When banknotes are dispensed, it can happen that, in order to dispense the cash amount requested by an operator of the apparatus, a banknote has to be removed from a bank acceptor that, in the dispensing sequence in which the banknotes can be removed from the banknote acceptor, is located behind other banknotes that are not supposed to be dispensed to the operator. These banknotes that are not to be dispensed, located in front of the banknote to be dispensed, are transported into the interim storage, and after all banknotes intended for dispensing have been removed from the banknote acceptor, are transported back to the banknote acceptor. What is achieved by this interim storage is that, in spite of banknotes of different denominations being accepted in a banknote acceptor, banknotes of the desired denomination can be removed from the banknote acceptor, and thus any desired amount can be dispensed to the operator.

In a preferred embodiment of the invention, a singulator and stacker for feeding banknotes into the respective banknote acceptor, or into the interim storage, and/or for removing banknotes from the respective banknote acceptor, or from the interim storage, is assigned to each banknote acceptor and/or to the interim storage. Further, at least one diverter is assigned to each respective banknote acceptor and/or the interim storage, with the aid of which the banknotes transported on a transport path and taken to the respective banknote acceptor or to interim storage are taken to the respective singulator and stacker assigned to the respective banknote acceptor or interim storage, and with the aid of which the banknotes removed from a banknote acceptor with the aid of a singulator and stacker are transported away. In this way, the result is that banknotes are removed simply and dependably from the banknote acceptors or the interim storage, or banknotes are fed simply and dependably into the banknote acceptor or the interim storage. The interim storage can be designed either as a roller storage system and/or as an endless transport path.

It is advantageous to provide a control unit with the aid of which the data stored in the memory element of each banknote acceptor can be read out and with the aid of which data can be written into memory areas of the memory elements of the banknote acceptors. It is particularly advantageous if, with the aid of the control unit, at least the singulators and stackers and/or the diverters can be activated at least as a function of one part of the data read out of the memory elements of the banknote acceptors. What is achieved thereby is that the selection of banknotes from which the bundle of banknotes to be dispensed is to be made up can be determined such that the bundle to be dispensed can be assembled as quickly as possible. What this further achieves is that the allocation to a banknote acceptor of a deposited banknote can be determined as a function of the banknotes already accepted in the banknote acceptor.

The invention further relates to a method for handling at least banknotes of a first denomination and banknotes of a second denomination. In a deposit transaction, the banknotes to be deposited are input via an input-and-output unit and then, with the aid of a reading unit, the genuineness of the deposited banknotes is verified and the respective denomination of the banknotes deposited is ascertained. The banknotes deposited are taken to banknote acceptors for acceptance of the banknotes. At least banknotes of the first denomination and banknotes of the second denomination are taken to at least one banknote acceptor. At least data containing information ascertained by the reading unit about the denominations of all banknotes accepted in the respective banknote acceptor and data containing information about the sequence in which the banknotes are arranged in the banknote acceptor are stored in the memory element of each banknote acceptor.

In a dispensing transaction, banknotes to be dispensed are taken from at least one banknote acceptor and output to an operator as a bundle with the aid of the input-and-output unit. The removal of banknotes to be dispensed from the banknote acceptor is ascertained at least as a function of the data stored in a memory element containing information about the denominations of all banknotes accepted in the respective banknote acceptor and containing information about the sequence in which the banknotes are arranged in the banknote acceptor.

It is advantageous if banknotes of a maximum two different denominations are accepted in each banknote acceptor. What is achieved thereby is that, in a dispensing transaction, fewer banknotes that should not be dispensed, and are located in a banknote acceptor in front of a banknote to be dispensed in the sequence in which the banknotes have to be removed from the banknote acceptor, have to be transported into interim storage. This reduces the time needed to assemble the bundle containing the banknotes to be dispensed.

In the preferred embodiment of the invention, the denomination of each of the banknotes to be dispensed is ascertained with the aid of the reading unit during the dispensing transaction. This ascertained denomination is compared with a target denomination ascertained with the aid of the data stored on the memory element of that banknote acceptor from which the banknote to be dispensed was removed. The banknote is only dispensed if the denomination ascertained and the target denomination are identical. If the denomination ascertained and the target denomination are not identical, an error must exist in the dispensing transaction. An error of this type may be a double or multiple draw-off of banknotes from a banknote acceptor and/or a banknote jam. Determining such errors at the time banknotes are removed from the banknote acceptor prevents a cash amount deviating from the cash amount requested from being dispensed to the operator. If the comparison of the denomination ascertained with the target denomination shows that the two values are not identical, the banknote is, or the banknotes are, taken to a special banknote acceptor intended for banknotes that are not to be dispensed again. Alternatively, the banknotes can be taken to interim storage. Following the completion of the dispensing transaction, the banknotes taken to interim storage can be removed individually from interim storage, the respective denomination of the banknotes ascertained with the aid of the reading unit and, depending on the denomination ascertained, taken to a banknote acceptor.

Furthermore, what is achieved by ascertaining the denomination of the banknotes to be dispensed at the time of the dispensing transaction is that there is no need for storing the banknotes being deposited during a deposit procedure in interim storage. Without ascertaining the denomination again during the dispensing transaction, banknotes to be deposited must be buffered in interim storage in order to be able to dispense the banknotes again to this operator in the event of a cancellation of the deposit process by the person depositing the banknotes.

In addition and as an alternative, multiple draw-offs of banknotes can be ascertained with the aid of devices for ascertaining multiple draw-offs of banknotes. Such a determination of multiple draw-offs can be advantageously performed with the aid of a thickness sensor to ascertain the thickness of one, or several, overlapping banknotes, and/or with the aid of at least one light curtain to ascertain the length of a sequence of banknotes consisting of one or several overlapping banknotes.

In addition, it is advantageous if, during the dispensing transaction, banknotes that are not to be dispensed, and are disposed ahead of a banknote to be paid out in the banknote acceptor in the sequence in which the banknotes must be taken from the banknote acceptor, are transported into interim storage, the banknote to be dispensed is removed, and the banknotes transported into interim storage are then transported into the banknote acceptor. The banknotes accepted in interim storage can either be transported back automatically into the banknote acceptor from which they were taken or, alternatively, transported into other banknote acceptors, wherein the banknotes are preferably distributed among the banknote acceptors in accordance with a preset rule of distribution.

In the deposit transaction, the banknotes to be conveyed are assigned to the individual banknote acceptors at least as a function of the denomination of the respective banknote to be conveyed, of the preset denominations of banknotes assigned to each banknote acceptor that can be accepted in the bank acceptor, the denominations of the banknotes already accepted in the respective banknote acceptors and/or the sequence in which the banknotes are disposed in the banknote acceptor. The banknotes are conveyed to their respective assigned banknote acceptors. Specifically, the distribution of the conveyed banknotes among the individual banknote acceptors takes place in accordance with a preset algorithm, by which it is to be ensured that as few banknotes as possible have to be transported into interim storage during later withdrawal transactions.

In an arrangement of banknotes with two different denominations in one banknote acceptor, the assignment of banknotes to be conveyed among the individual banknote acceptors can be made, for example, so that an alternating arrangement of the banknotes of the two denominations is achieved as far as possible. Alternatively, the assignment to a banknote acceptor of a banknote to be conveyed can be made such that when conveyed banknotes of the same denomination can be accepted optionally in two different banknote acceptors, conveyed banknotes with said denomination are conveyed to one of the two banknote acceptors until this banknote acceptor has reached the maximum number, and only then are banknotes taken to the other banknote acceptor. Furthermore, the banknotes to be conveyed to the banknote acceptors can be distributed among the banknote acceptors in such a way that banknotes with as many different denominations as possible are arranged in each banknote acceptor.

It is further advantageous if it is ascertained at the time of the dispensing transaction which banknote is to be removed from which banknote acceptor before the first banknote to be dispensed is removed from a specific banknote acceptor. In this way, the time needed to output the banknotes to be dispensed to an operator is reduced compared with an iterative removal of banknotes from the banknote acceptors.

It is particularly advantageous if at least two banknotes of the bundle to be dispensed that are located in different banknote acceptors and are taken to a transport path at different points are removed from the banknote acceptors simultaneously. In this way, the time needed to output the banknotes of the bundle to be dispensed to the operator with the aid of the input-and-output unit can be further reduced.

The apparatuses specified by the claims for the apparatus can be further developed in the same way as described for the process in accordance with the invention. Specifically, the apparatuses with the features cited in the dependent claims referring back to the methods, or corresponding apparatus features, can be further developed. Similarly, the methods specified by the claims for the methods can be further developed in the same way as described for the apparatuses in accordance with the invention. In particular, the methods with the features, or corresponding methods features, cited in the dependent claims referring back to the apparatus can be further developed.

BRIEF DESCRIPTION OF THE DRAWINGS

Additional features and advantages of the invention will be become apparent from the following description, which explains the invention in greater detail in conjunction with the appended figures using embodiments.

DESCRIPTION OF THE PREFERRED EMBODIMENTS

Figure 1:
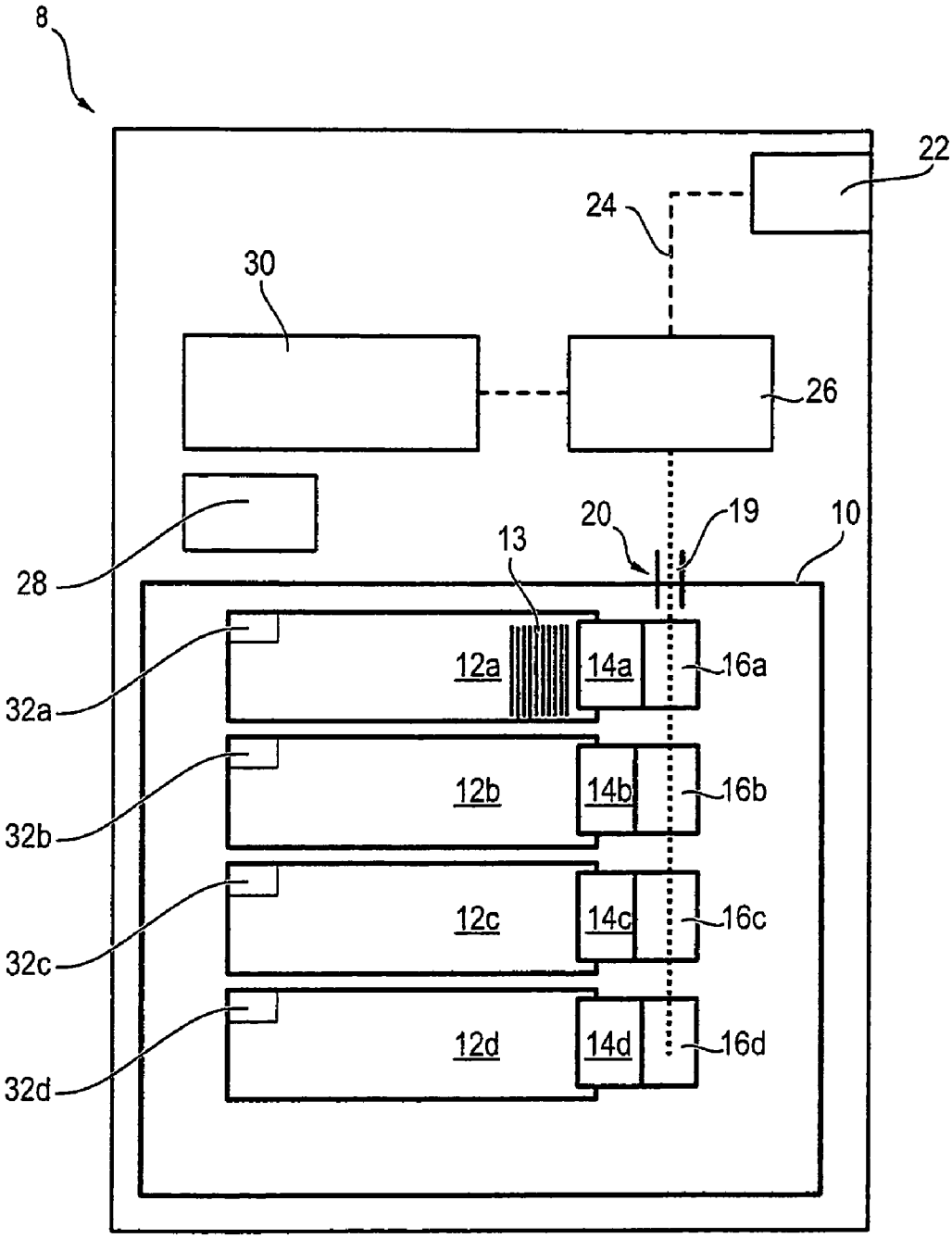
FIG. 1 shows a schematic representation of an automated teller machine.

FIG. 1 shows a schematic representation of an automated teller machine 8. The automated teller machine 8 is used by an operator to deposit banknotes as well as to dispense banknotes to an operator. An automated teller machine 8 of this type, which serves both to deposit and to dispense banknotes, is also described as a recycling teller machine. Alternatively, the automated teller machine 8 can also serve exclusively to disburse banknotes or to deposit banknotes. Furthermore, the method and the apparatus in accordance with the invention can also be used in other banknote handling equipment, specifically in automated cash systems and what are called automated safes.

The automated teller machine 8 comprises a strong box 10 in which four money cassettes 12*a* to 12*d* are located and which protects the money cassettes 12*a* to 12*d* against unauthorized access, specifically theft and attempted manipulation. The money cassettes 12*a* to 12*d* serve to store and to transport banknotes. The banknotes are deposited in the money cassettes 12*a* to 12*d* in the form of a stack. An example of one of these stacks is indicated in the first money cassette 12*a*. One of the banknotes in this stack of banknotes is designated as an example with the reference numeral 13.

Each money cassette 12*a* to 12*d* has an opening for the delivery of banknotes 13 and the removal of banknotes 13. A singulator and stacker 14*a* to 14*d* is located in front of the opening of respective money cassettes 12*a* to 12*d*, with the aid of which, firstly, banknotes 13 can be taken to the money cassettes 12*a* to 12*d*, and, secondly, banknotes 13 stored in money cassettes 12*a* to 12*d* can be singulated from the respective stacks of bank notes accepted into the money cassettes 12*a* to 12*d* and removed from money cassettes 12*a* to 12*d*. A diverter 16*a* to 16*d* is located in front of each singulator and stacker 14*a* to 14*d*, with the aid of which a banknote 13 transported along a transport path 19 which is to be taken to one of the money cassettes 12*a* to 12*d* is branched off from the transport path 19 and taken to the singulator and stacker 14*a* to 14*d* located in front of the money cassette 12*a* to 12*d* into which the banknote 13 is to be transported. Similarly, the diverters 16*a* to 16*d* serve to transport banknotes 13 removed with the aid of the singulator and stacker 14*a* to 14*d* from the money cassettes 12*a* to 12*d* on the transport path 19.

The automated teller machine 8 further encompasses an input-and-output drawer 22 via which banknotes 13 to be deposited can be input by an operator in the automated teller machines 8, and banknotes 13 to be dispensed can be issued to an operator. With a teller machine exclusively for withdrawals, banknotes 13 are only dispensed via the input-and-output drawer 22, with a teller machine exclusively for deposits, banknotes 13 are only deposited via the input-and-output drawer 22. The banknotes 13 can be transported between the input-and-output drawer 22 with the aid of a first transport unit 24. The first transport unit 24 preferably comprises at least one roller, at least one cylinder and/or at least one transport belt. The rollers, cylinders and transport belts are advantageously located in pairs so that the banknotes 13 to be transported are transported between the rollers of a pair of rollers, or the cylinders of a pair of cylinders, or the belts of a pair of belts. The transport of banknotes 13 along transport path 19 from reading unit 26 to money cassettes 12*a* to 12*d*, or from the money cassettes 12*a* to 12*d* to reading unit 26, is carried out with the aid of a second transport unit. The second transport unit similarly advantageously comprises at least one roller, at least one cylinder and/or at least one transport belt.

The banknotes 13 deposited via the input-and-output drawer 22 are singulated and, with the aid of first transport unit 24, taken individually to reading unit 26 with the aid of which the genuineness of the deposited banknotes 13 and the denomination of each deposited banknote 13 is ascertained. Depending on at least the ascertained genuineness and the ascertained denomination of the banknote 13, said banknote 13 is taken to one of the money cassettes 12*a* to 12*d*. At least banknotes 13 suspected of being counterfeit and banknotes 13 that, because of their denomination, are not intended for dispensing again are kept in the first money cassette 12*a*. In the eurozone, only banknotes with a denomination <=100 euros are dispensed by automated teller machines. Deposited 200 euro and 500 euro banknotes are not dispensed again and are therefore stored in the first money cassette 12*a*. The first cassette 12*a* is also described as a deposit cassette. Since the banknotes 13 accepted in a deposit cassette 12*a* are not dispensed again, deposit cassette 12*a* has to be configured only in such manner that it can accept banknotes 13. It is not necessary to remove banknotes 13 by way of first singulator and stacker 14*a* from deposit cassette 12*a*. The construction and the operation of suitable singulators and stackers are described in detail in DE 102008018935. The content disclosed there of the construction and operation of singulators and stackers is incorporated by reference in the present description in its entirety.

In the case of money cassettes 12*b* to 12*d*, said cassettes are known as recycling cassettes to which banknotes 13 can be both taken and from which banknotes 13 can also be removed. Only banknotes 13 of a first denomination are stored in the first recycling cassette 12*b*. The storage of banknotes 13 of only one denomination in a money cassette 12*a* to 12*d* is described as single-item storage. Banknotes of a second denomination and banknotes of a third denomination are stored in the second recycling cassette. Banknotes of the third denomination and banknotes of a fourth denomination are stored in the third recycling cassette 12*d*. To simplify the further elaborations, it is assumed in what follows that euro banknotes are handled in automated teller machine 8. In this case, 5 euro banknotes are stored in the first recycling cassette 12*b*, 10 euro and 20 euro banknotes are stored in the second recycling cassette 12*c*, and 20 euro and 50 euro banknotes are stored in the third recycling cassette 12*d*. In the embodiment from FIG. 1, 100 euro banknotes are not disbursed. One-hundred euro banknotes deposited are taken to deposit cassette 12*a*. Storing banknotes 13 of different denominations in one money cassette 12*a* to 12*d* is also described as mixed storage.

Alternatively, another assignment of the denominations of banknotes 13 to the individual money cassettes 12*a* to 12*d* can also be made. In particular, 5 euro banknotes and 10 euro banknotes can be stored in the first recycling cassette 12*b*, 10 euro banknotes and 20 euro banknotes in the second recycling cassette 12*c*, and 20 euro banknotes and 50 euro banknotes in the third recycling cassette 12*d*. Alternatively, banknotes 13 of other currencies and/or other denominations can be correspondingly stored in money cassettes 12*a* to 12*d*. The deposit process, specifically the assignment of the money cassette 12*a* to 12*d* to which a deposited banknote 13 is taken, is described in detail in conjunction with FIG. 2.

When banknotes 13 are withdrawn, an operator enters the cash amount that said operator would like to have dispensed with the aid of an input unit not shown, specifically with the aid of a touch screen. A determination is made with the aid of a control unit 28 which banknotes 13 are needed to dispense the requested cash amount by way of the input-and-output drawer. The banknotes 13 to be dispensed 13 are removed from the recycling cassettes 12*b* to 12*d* and, with the aid of the first transport unit 24 and the second transport unit, taken to the input-and-output drawer, where they are dispensed to the operator as a bundle. When banknotes 13 are removed from a recycling cassette 12*b* to 12*d* with the aid of singulators and stackers 14*b* to 14*d*, only banknote 13 that is disposed in the banknote stack stored in the recycling cassette 12*b* to 12*d* at the end that faces the singulators and stackers 14*b* to 14*d* can be removed. The sequence in which the banknotes 13 can be removed from a recycling cassette 12*b* to 12*d* is also termed the draw-off sequence. If a banknote is needed for dispensing that is located in the draw-off sequence behind other banknotes 13 that are not suitable for dispensing, the banknotes not suitable for dispensing are transported to interim storage 30, the banknote to be dispensed 13 is taken from the recycling cassette 12*b* to 12*d* and taken to the input-and-output unit. Regarding the interim storage 30, it is specifically a roller storage system or other endless transport path. Alternatively, the interim storage can be designed as stack storage, specifically a money cassette. Alternatively, banknotes 13 not intended for dispensing can be transported into deposit cassette 12*a* instead of into interim storage 30. The dispensing process will be described in detail in what follows in conjunction with FIG. 3.

Each of the money cassettes 12*a* to 12*d* has respectively at least two delimiting elements, with the aid of which the dimensions of a receiving area in which the banknotes taken to the respective money cassette 12*a* to 12*d* are stored can be adjusted, so that only banknotes 13 can be stacked in money cassette 12*a* to 12*d* that are of the denomination of the banknotes 13 that are to be accepted in the respective money cassette 12*a* to 12*d*. Regarding the delimiting elements, they are preferably vertical and lateral stops. With the aid of the lateral stop, the length of the long side of the banknotes 13 that can be accepted in the respective money cassette 12*a* to 12*d* is limited. With the aid of the vertical stop, the length of the short side of the banknotes 13 that can be accepted in the respective money cassette 12*a* to 12*d* is limited. Banknotes 13 that have larger dimensions than those banknotes 13 with the largest dimensions that are to be accepted in the respective money cassettes 12*a* to 12*d*, cannot be brought to the money cassette 12*a* to 12*d* without difficulty. Banknotes with smaller dimensions than those banknotes with the smallest dimensions that are to be accepted in the respective money cassette, can be taken to the respective money cassette 12*a* to 12*d* but not stacked properly in said cassette so that when banknote 13 is drawn off from the cassette 12*a* to 12*d*, multiple draw-offs, oblique draw-offs and/or note jams can occur.

Each of the money cassettes 12*a* to 12*d* comprises respectively an electronic memory element 32*a* to 32*d* with at least one memory area in which data are stored with information about the denominations of all banknotes 13 that have been accepted in the respective money cassette 12*a* to 12*d*, data with information about the sequence in which banknotes 13 have been accepted in the respective money cassette 12*a* to 12*d*, the number of banknotes 13 accepted in the respective money cassette 12*a* to 12*d*, and/or data with information about which denominations of banknotes 13 have been assigned to the respective money cassette 12*a* to 12*d*. As will be explained in more detail hereinafter in conjunction with FIGS. 2 and 3, these data stored in the memory areas of the memory elements 32*a* to 32*d* are required for the deposit and dispensing process.

The data can be written electronically into the memory area and read out electronically from the memory area, preferably written and read contactlessly. At least the memory area in which the data mentioned, or part of the data mentioned, are stored is a non-volatile memory, preferably a flash memory such as an EEPROM.

The data stored in the memory areas of the memory elements 32*a* to 32*d* can be read out with the aid of control unit 28. In addition, with the aid of control unit 28, data can be stored in the memory areas of the memory elements. Specifically, the denominations of those banknotes 13 that are taken to the respective money cassette 12*a* to 12*d* and the sequence of the banknotes taken there are saved in the memory areas of the memory elements 32*a* to 32*d*. With the aid of the data saved in the memory areas of the memory elements 32*a* to 32*d*, complete inventory management is implemented.

The money cassettes 12*a* to 12*d* can be removed from the automated teller machine 8 through an opening, not shown in FIG. 1, in strong box 10, and other money cassettes can be brought to the automated teller machine 8. By reason of the data stored in the memory area of the respective memory element 32*a* to 32*d* of a money cassette 12*a* to 12*d*, money cassettes 12*a* to 12*d* that were removed from an automated teller machine 8 can be taken to another automated teller machine 8 without the banknotes 13 accepted in money cassette 12*a* to 12*d* having to be removed, and money cassette 12*a* to 12*d* having to be filled with different banknotes 13. This reduces logistic complexity and the costs associated therewith. Specifically, full money cassettes 12*a* to 12*d* from an automated deposit teller machine can be used in a automated dispensing teller machine. Full money cassettes 12*a* to 12*d* from a deposit-heavy automated recycling teller machine 8, in which more banknotes 13 have been deposited than dispensed, can be exchanged with the money cassettes 12*a* to 12*d* from a disbursal-heavy automated recycling teller machine 8 in which more banknotes 13 have been dispensed than deposited.

When a new money cassette 12*a* to 12*d* is used in the automated teller machines 8, the data stored in the memory area of the memory element 32*a* to 32*d* of the money cassette 12*a* to 12*d* are read out by the control unit 28 and taken into account when future deposit and dispensing transactions are performed. The exchange of money cassettes 12*a* to 12*d* between automated teller machines 8 without the prior removal of the banknotes 13 accepted into the money cassettes 12*a* to 12*d* and filling with other banknotes 13 is also described as second-order recycling.

In addition, or as an alternative, to memory elements 32*a* to 32*d*, all automated teller machines 8 can be linked to a central memory and control unit in whose memory areas data with information about the denominations of those banknotes 13 that have been accepted in a money cassette 12*a* to 12*d*, data with the sequence in which banknotes 13 are disposed in respective money cassette 12*a* to 12*d*, and/or data with information about the number of banknotes 13 that have been accepted in the respective money cassette 12*a* to 12*d*, are stored for each money cassette 12*a* to 12*d* of all automated teller machines 8 connected to the central memory and control unit. Moreover, each money cassette 12*a* to 12*d* includes a unique identifier that is preferably stored in the memory area of the memory element 32*a* to 32*d* of the respective money cassette 12*a* to 12*d* or in a further preferably read-only memory area of memory element 32*a* to 32*d*. When a money cassette 12*a* to 12*d* is removed from an automated teller machine 8 and taken to a different automated teller machine 8, the money cassette 12*a* to 12*d* in question can be identified unequivocally with the aid of the unique identifier, and the data assigned to this money cassette 12*a* to 12*d* stored in the central memory and control unit can be taken into account during future deposit and dispensing transactions of the automated teller machine 8 into which the money cassette 12*a* to 12*d* has been accepted, in addition to the data stored in the memory area of the memory unit 32*a* to 32*d*.

The control unit 28 further serves to actuate diverters 16*a* to 16*d* of the singulator and stacker 14*a* to 14*d*. Similarly, reading unit 26, the input-and-output drawer 22, the first transport unit and the second transport unit can be controlled with the aid of control unit 28.

Figure 2:
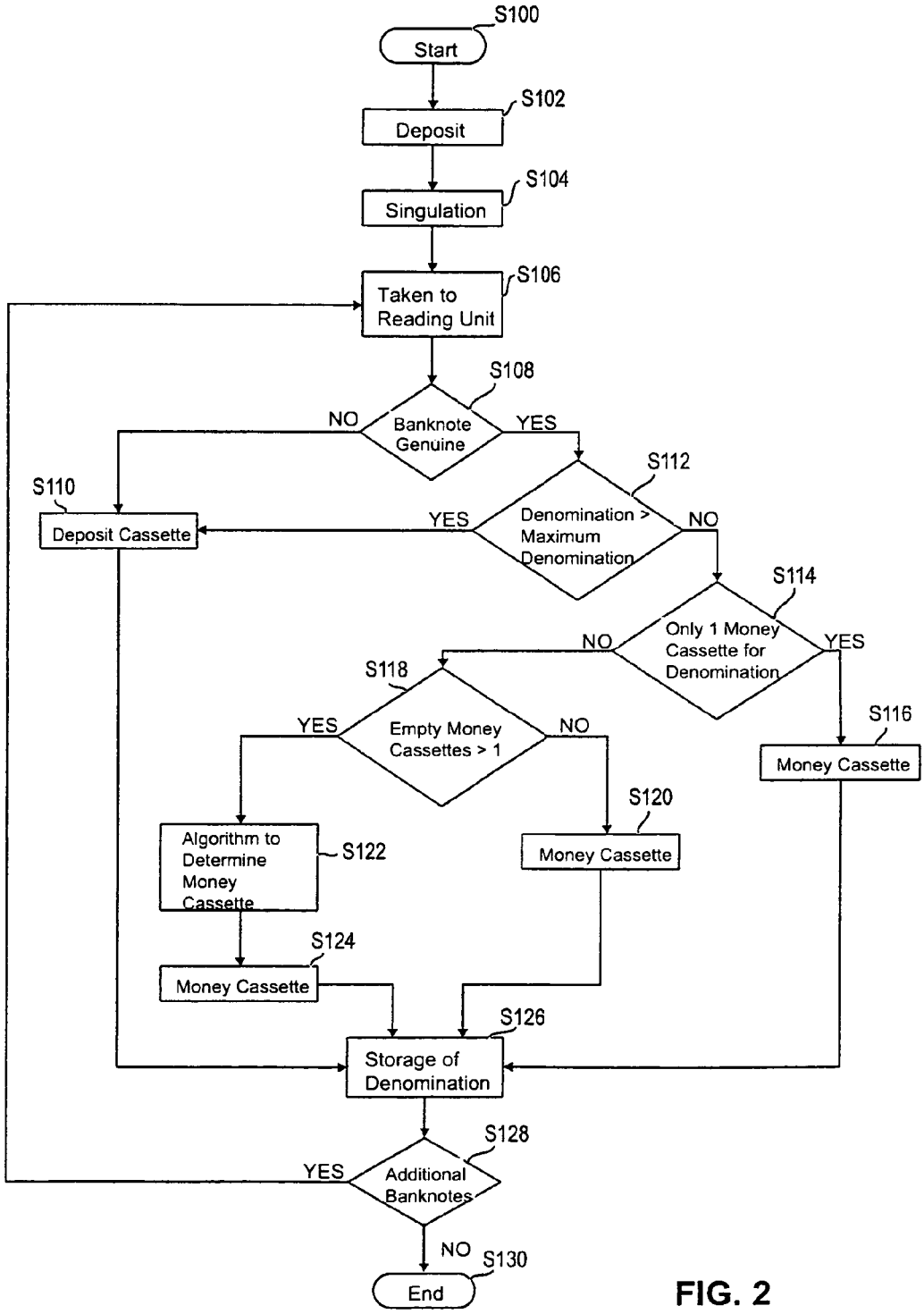
FIG. 2 shows a flow chart of a deposit transaction.

FIG. 2 shows a flow chart for a deposit transaction. Elements with the same structure or same function have the same reference numerals. The deposit transaction is started in step S100. The deposit by the operator of banknotes 13 to be deposited into the input-and-output unit 22 of the automated teller machine 8 takes place in step S102. The banknotes 13 deposited are singulated with the aid of a singulator in step S104 and taken individually in step 106 to the reading unit 26.

In the next step S108, the reading unit 26 first verifies the genuineness of the banknote 13 brought in. If the banknote 13 brought in is classified as a suspected counterfeit, it is taken to deposit cassette 12*a* in step S110.

If, on the other hand, banknote 13 is classified as genuine in step S108 during verification of its genuineness, the denomination of the banknote is ascertained in step S112. The denomination ascertained is compared with a maximum denomination. The maximum denomination is preferably the largest possible permissible denomination for the automated teller machine of a banknote 13 to be dispensed. In accordance with the embodiment from FIG. 1, the maximum denomination is 50 euros. If the result of the comparison of the denomination ascertained with the maximum denomination is that the denomination ascertained is greater than the maximum denomination, the banknote 13 is taken to the deposit cassette. If, on the other hand, the denomination ascertained is smaller than, or the same as, the maximum denomination, it is ascertained in the following steps S114, S118, S122 to which recycling cassette 12*b* to 12*d* banknote 13 is to be taken.

To do this, it is first ascertained in step S114, how many recycling cassettes 12*b* to 12*d* are available to accept banknotes 13 having the denomination ascertained. If this determination in step S114 shows that only one recycling cassette 12*b* to 12*d* is provided to accept banknotes 13 of the denomination ascertained, the banknote is taken to the recycling cassette 12*b* to 12*d* in step S116.

On the other hand, if more than one recycling cassette 12*b* to 12*d* is provided for accepting banknotes 13 of the ascertained denomination, the fill level of all recycling cassettes 12*b* to 12*d* that are provided to accept banknotes 13 of the ascertained denomination is determined first. If this determination shows that only one of the identified recycling cassettes 12*b* to 12*d* that are provided for the acceptance of banknotes 13 of the ascertained denomination, is not completely filled and all the other recycling cassettes 12*b* to 12*d* intended for the acceptance of banknotes 13 with the ascertained denomination are completely filled, the banknote 13 is taken to the recycling cassette 12*b* to 12*d* that is not completely filled.

If, on the other hand, it is determined in step S118 that more than one recycling cassette 12*b* to 12*d* intended for the acceptance of banknotes 13 of the denomination ascertained is not completely filled, an algorithm is started in step S122 to ascertain the recycling cassette 12*b* to 12*d* to which the banknote 13 is to be taken. The determination of the recycling cassettes 12*b* to 12*d* to which a banknote 13 is to be taken can proceed according to different strategies. In a first strategy, a fixed sequence is preset in which those of the recycling cassettes 12*b* to 12*d* intended for the acceptance of banknotes 13 of the denomination ascertained are to be filled. For example, if the second recycling cassette 12*c* and the third recycling cassette 12*d* are intended for the acceptance of banknotes 13 with the denomination ascertained, the second recycling cassette is filled with banknotes 13 of the denomination ascertained until the second recycling cassette is completely filled.

In a second strategy, the banknotes 13 are assigned to the recycling cassettes 12*b* to 12*d* in such a manner that the banknotes 13 are disposed in the respective recycling cassettes 12*b* to 12*d* alternating as far as possible. For example, if 10 euro and 20 euro banknotes are accepted in the second recycling cassette 12*c*, then the assignment of banknotes 13 to the individual money cassettes 12*b* to 12*d* is made in such manner that the 10 euro and the 20 euro banknotes are disposed alternately in the second recycling cassette 12*c*, given suitable availability.

In a third strategy, the determination of the recycling cassette 12*b* to 12*d* to which the banknote 13 with the denomination ascertained is to be taken is made in such manner that those banknotes 13 that are respectively disposed in first position in the draw-off sequence for the individual recycling cassettes 12*b* to 12*d* have different denominations.

Alternatively, a dynamic algorithm can be used in which the determination of the recycling cassette 12*b* to 12*d* to which the banknote 13 is to be taken is made as a function of the deposit or withdrawal activities completed previously. In this way, the allocation of banknotes 13 deposited to the individual recycling cassettes 12*b* to 12*d* can be modified to suit changed behavior on the part of the operators, for example, because of a public event such as a folk festival.

If it was determined in step S122 with the aid of the algorithm to which of the recycling cassettes 12*b* to 12*d* banknote 13 is to be taken, banknote 13 is transferred to this recycling cassette 12*b* to 12*d* in step S124. If the determination of the recycling cassette 12*b* to 12*d* to which banknote 13 is to be transferred shows that transferring banknote 13 to one of the recycling cassettes 12*b* to 12*d* that are intended for acceptance of banknotes 13 with this denomination is disadvantageous because, for example, rapid dispensing of banknotes 13 is made more difficult as a result, banknote 13 can also be transferred to deposit cassette 12*a* in step S124.

After banknote 13 has been transferred to one of the recycling cassettes 12*b* to 12*d*, or deposit cassette 12*a*, in steps S110, S116, S120 or S124, data containing at least information about the ascertained denominations of transferred banknote 13 are stored in step S128 in the memory area of memory elements 32*a* to 32*d* of recycling cassettes 12*b* to 12*d*, or of deposit cassette 12*a*, to which banknote 13 was transferred. Then, in step S128, a determination is made whether all banknotes 13 deposited have been transferred to a recycling cassette 12*b* to 12*d*, or to deposit cassette 12*a*. If all the banknotes 13 deposited have not yet been transferred to a recycling cassette 12*b* to 12*d*, or to deposit cassette 12*a*, the sequence described starts again with step S106 in which the next banknote 13 deposited is taken to the reading unit 26, and then steps S108 to S128 are completed. The individual steps for several deposited banknotes 13 are preferably performed in parallel. Specifically, the transfer of the next banknotes 13 to the reading unit 26 is already taking place while the previous banknote 13 is being transported into one of the recycling cassettes 12*b* to 12*d* or into deposit cassette 12*a*. If, on the other hand, it is ascertained in step S128 that all the banknotes 13 deposited have been transferred to recycling cassettes 12*b* to 12*d*, or to deposit cassette 12*a*, the deposit transaction is concluded with step S130.

Figure 3:
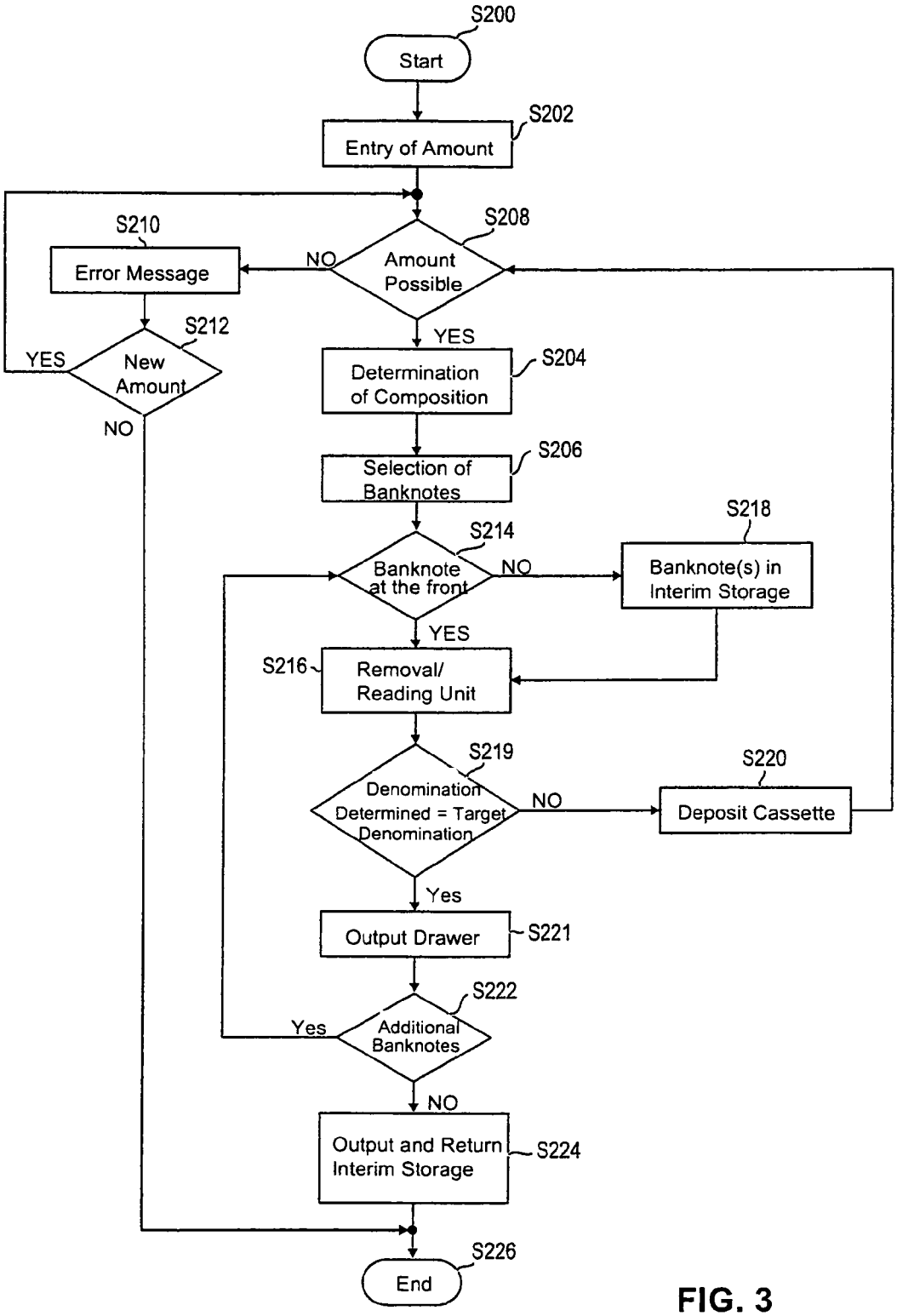
FIG. 3 shows a flow chart for a dispensing transaction.

FIG. 3 shows a flow chart of a dispensing transaction. The dispensing transaction is started in step S200. In the next step, S202, the requested cash amount to be dispensed is input by an operator with the aid of the input unit of the automated teller machine 8.

A check is made in step S208 whether the cash amount requested can be dispensed. If it turns out that the cash amount requested cannot be dispensed because it cannot be assembled using the banknotes 13 kept in recycling cassettes 12*b* to 12*d*, an error message is issued to the operator in step S210 by way of a display unit. The operator is further requested to enter a new amount. Alternatively, possible amounts for dispensing may be proposed to the operator for selection.

If no new amount is entered in step S212, the dispensing transaction is terminated. If a new amount is entered, the sequence described is continued with step S208, and the verification is made whether the new amount requested can be dispensed.

If, on the other hand, it is ascertained in step S208 that the amount requested can be dispensed, it is ascertained in step S204 how many banknotes 13 of which denomination are to be contained in the bundle that is dispensed to the operator at the end of the withdrawal transaction. This composition of the bundle to be dispensed is also described as denomination mix. Determination of the denomination mix of the bundle to be dispensed can be made in different ways.

The first possibility is that a preset denomination mix is saved for each possible amount for dispensing, and the same cash amount requested is always dispensed using the same denomination mix. A second possibility is that the denomination mix can be freely selected by the operator, or at least within preset limits. A bundle of this type is described as customer-optimized.

A third possibility is that the denomination mix is ascertained by the control unit 28 depending at least on the data saved in the memory areas of the memory elements 32*a* to 32*d* with information about the denominations of all banknotes 13 kept in the respective money cassettes 12*a* to 12*d* and the sequence in which banknotes 13 are disposed in the respective money cassettes 12*a* to 12*d*. The determination of the denomination mix is made specifically in such a manner that the time required to dispose the bundle to be dispensed in the input-and-output unit 22 is minimized. Alternatively, or in addition, the determination of the denomination mix can be made in such a manner that all possible cash amounts can still be dispensed at further withdrawals. A denomination mix of this type is described as inventory-optimized.

After the denomination mix has been ascertained in step S204, the selection of banknotes 13 is made in step S206 from which the bundle to be dispensed is to be assembled. In step S214, the position is ascertained for the first banknote 13 to be dispensed in the draw-off sequence of the recycling cassette 12*b* to 12*d* in which banknote 13 is located. If banknote 13 is located at the front in the draw-off sequence, i.e. banknote 13 can be removed directly with the aid of the singulator and stacker 14*b* to 14*d* of the corresponding recycling cassette 12*b* to 12*d*, banknote 13 is removed from recycling cassette 12*b* to 12*d* and transferred to reading unit 26. If, on the other hand, it is ascertained in step S214 that banknote 13 is not located at the front in the draw-off sequence, all banknotes 13 that are located in front of banknote 13 to be dispensed in the corresponding recycling cassette 12*b* to 12*d*, and are not themselves to be dispensed, are transferred in step S218 into interim storage 30. Alternatively, these banknotes 13 can also be transported into deposit cassette 12*a*. Then, in step S216, banknote 13 to be dispensed is transferred to reading unit 26. With the aid of reading unit 26, the denomination of the transferred banknote 13 is ascertained.

The denomination of banknote 13 ascertained is compared with a target denomination for banknote 13 in step S219. The target denomination of banknote 13 is the denomination that banknote 13 should have, based on the data stored in the memory area of memory element 32*b* to 32*d* of recycling cassettes 12*b* to 12*d* from which banknote 13 was taken, and, on the basis of which this banknote 13 was picked when selecting the banknotes 13 from which the bundle will be made up.

If the comparison of the denomination ascertained with the target denomination of banknote 13 shows that the denomination ascertained of banknote 13 and the target denomination of banknote 13 show a discrepancy, banknote 13 is transferred to interim storage 30 in step S220. Reasons for the discrepancy between the denomination ascertained and the target denomination may be double or multiple draw-offs of banknote 13, for example, and/or banknote jams. Since it can happen as the result of the multiple draw-off of banknotes 13 or banknote jams that the requested amount is not dispensed to the operator, banknotes 13 are taken to deposit cassette 12*a*.

A second check is then made in step S208 whether the requested amount for withdrawal can be paid out even without this banknote 13 that was taken to deposit cassette 12*a*. In accordance with the result, steps S204 to S221 are run through again.

If the comparison of the denomination ascertained of banknote 13 with the target denomination of banknote 13 in step S219 shows, on the other hand, that the ascertained and the target denomination agree, banknote 13 is transported in step S221 into an output drawer. Then, in step S222, it is ascertained whether all banknotes 13 to be dispensed are already located in the output drawer. If this is not the case, the sequence starts over again with step S214 for the next banknote 13 to be withdrawn from the recycling cassettes 12*b* to 12*d*.

In an advantageous further aspect of the invention, the removal of banknotes 13 to be dispensed from various recycling cassettes 12*b* to 12*d* takes place simultaneously so that the time needed to prepare the bundle to be dispensed in the input-and-output unit 22 is reduced. If all the banknotes to be dispensed are prepared in the input-and-output unit 22, the bundle to be dispensed is output to the operator in step S224. Parallel to this, banknotes 13 that were transported into interim storage 30 during the dispensing transaction are returned. Banknotes 13 from interim storage 30 are transported back into the respective recycling cassette 12*b* to 12*d* from which they were removed. Alternatively, the banknotes 13 buffered in interim storage 30 can also be transferred in part or in full to another recycling cassette 12*b* to 12*d* than recycling cassette 12*b* to 12*d* from which they were removed. Specifically, the determination of the recycling cassette 12*b* to 12*d* in which a banknote 13 from interim storage 30 is to be accepted can be made in accordance with the strategies described in conjunction with FIG. 2 for ascertaining the recycling cassette 12*b* to 12*d* to which a banknote 13 to be deposited is to be taken.

In an alternative embodiment of the invention, the banknotes 13 to be interimed in interim, storage can be taken to reading unit 26. The respective denomination of the banknotes 13 is ascertained with the aid of reading unit 26. The denomination ascertained is compared, analogously to step S218, with the target denomination. If the comparison of the denomination ascertained with the target denomination shows that the denomination ascertained and the target denomination agree, banknote 13 is taken to interim storage 30. If the comparison of the denomination ascertained with the target denomination shows, on the other hand, that the denomination ascertained differs from the target denomination, banknote 13 is taken to deposit cassette 12*a*.

In a further alternative embodiment of the invention, if it was ascertained in step S208 that the requested cash amount cannot be dispensed, a bundle with an amount that is closest of all possible dispensable amounts to the amount requested can be suggested and dispensed after being confirmed. With this embodiment of the invention, steps S210 and S212 are eliminated.

Figure 4:
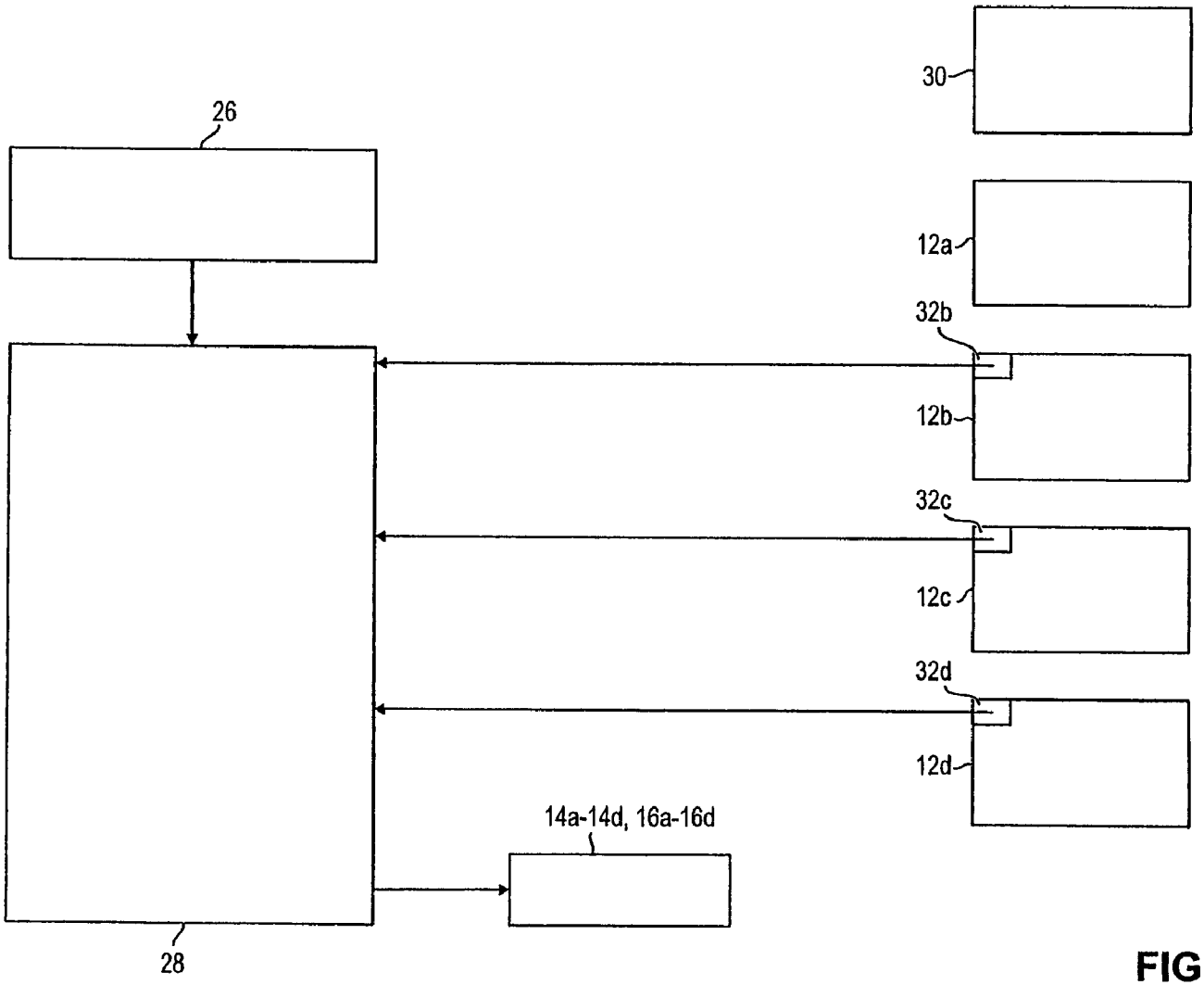
FIG. 4 shows a chart of the information flows of the control unit.

FIG. 4 is a chart with the data streams of control unit 28 shown. Control unit 28 reads out the data stored in the memory areas of memory elements 32*b* to 32*d* of recycling cassettes 12*b* to 12*d*. In addition, the denominations ascertained of the banknotes 13 to be deposited, dispensed or buffered in interim storage are transmitted by reading unit 26 to control unit 28. Furthermore, reading unit 26 transmits to control unit 28 the result of the genuineness verification of a banknote 13 to be deposited. The control unit activates at least singulators and stackers 14*a* to 14*d* and/or diverters 16*a* to 16*d* as a function of the memory areas of memory elements 32*b* to 32*d* of recycling cassettes 12*b* to 12*d*, data read out and the data transmitted by reading unit 26.

In the embodiment shown in FIG. 4, deposit cassette 12*a* does not have a memory element 32*a*. Since the banknotes 13 accepted in deposit cassette 12*a* are not intended for a withdrawal, deposit cassette 12*a* is also not transferred to another automated teller machine 8 so that a memory element 32*a* is not necessary.

In an alternative embodiment of the invention, only those banknotes 13 are deposited in deposit cassette 12*a* the denomination of which is larger than the maximum denomination. Banknotes 13 suspected of being counterfeit, on the other hand are deposited in a separate, fifth money cassette. Furthermore, automated teller machine 8 may have a sixth money cassette in which those banknotes 13 are deposited that were clearly identified as forgeries.

If a bundle for withdrawal is not removed by the operator from the input-and-output drawer 22, banknotes 13 from the bundle not removed are distributed among the various money cassettes 12*b* to 12*d*, in a manner similar to the sequence of the deposit transaction from FIG. 2. What is achieved by this is that banknotes 13 from the bundle not removed are available again for later withdrawals. Any manipulation of the bundle by the operator, specifically exchanging real banknotes 13 in the bundle for forgeries can be detected with the aid of the genuineness verification by reading unit 26. Alternatively, banknotes 13 from a bundle for disbursal not removed can be transported to deposit cassette 12*a*.

If a deposit transaction is cancelled by the operator, i.e. the operator would like to make the deposit transaction retroactive, the dispensing of the amount of cash deposited takes place similarly to the withdrawal transaction described in FIG. 3. In this way, there is no need for interim storage of the deposited banknotes 13 during the deposit transaction.

In a preferred embodiment of the invention, deposit cassette 12*a* is similarly configured as a recycling cassette so that banknotes 13 taken to deposit cassette 12*a* can be removed from deposit cassette 12*a* again. In this way, in the event of a cancellation of a deposit, the bundle to be dispensed again to the operator can be compiled from the same banknotes 13 of which the deposited bundle was made up.

With the aid of control unit 28, the fill level of individual money cassettes 12*a* to 12*d* is continuously monitored. If it should turn out that fewer banknotes 13 of one denomination than a preset minimum stock of banknotes 13 of this denomination are available in automated teller machine 8, control unit 28 sends information to a service person or central service office as the result of which the service person is requested to refill the stock of banknotes 13 of this denomination.

If, during a withdrawal, the comparison of the denomination ascertained of banknote 13 to be dispensed with the target denomination for banknote 13 shows that the denomination ascertained of banknote 13 diverges from the target denomination, it is ascertained with the aid of preset algorithms which banknote 13 is now at the frontmost position in the draw-off sequence for that recycling cassette 12*b* to 12*d* from which the banknote 13 to be originally dispensed was taken. Specifically, the denomination ascertained of banknote 13 is compared with the denominations of those banknotes 13 that are located behind the banknote originally to be dispensed in the draw-off sequence for recycling cassette 12*b* to 12*d* from which the banknote 13 to be dispensed was taken.

For the event that because of multiple draw-offs, for example, the stock of one or more money cassettes 12*a* to 12*d* cannot be ascertained by control unit 28, an emergency algorithm is stored in control unit 28 for dispensing banknotes 13. In this emergency algorithm, the determination of the banknotes to be dispensed proceeds in steps. In a first step, the cash amount requested for disbursement is divided by the denomination of the banknote intended for disbursal with the largest denomination. The ascertained value is rounded up to the next whole number. If this ascertained value is greater than 0, the corresponding number of banknotes 13 is removed from money cassette 12*a* to 12*d* in which banknotes 13 are contained of the denomination by which the requested sum of money was divided. If the ascertained value is 0, the requested sum of money is divided by the denomination of the banknote 13 with the next smaller denomination that is contained in a different recycling cassette 12*b* to 12*d* than the banknotes 13 with the larger denominations, and the value thus obtained rounded down to the next whole number. This procedure is repeated until a value not equal to 0 is ascertained.

The denominations of all banknotes 13 removed from a money cassette 12*a* to 12*d* in this way are ascertained with the aid of reading unit 26 and totaled. The totaled value is subtracted from the sum of money requested. In this way, a remainder is obtained. The remainder ascertained is in turn divided by the denomination of banknote 13 with the largest denomination that is intended for disbursement, and the value ascertained is rounded down to the next whole number. If this value is not equal to 0, the corresponding number of banknotes 13 is removed from the corresponding money cassette 12*a* to 12*d*. This procedure is repeated until the remainder is 0.

The emergency algorithm is explained in what follows using an example. It is assumed in this example that automated teller machine 8 comprises four money cassettes 12*a* to 12*d*, where 100 euro, 200 euro and 500 euro banknotes are located in the first money cassette 12*a*, 50 euro banknotes are located in the second money cassette 12*b*, 10 euro and 20 euro banknotes are located in the third money cassette 12*c*, and 5 euro banknotes are located the fourth money cassette 12*d*. The requested sum of money to be dispensed is 1,850 euros. In the first step, the 1,875 euros are divided by 500 euros, and the value obtained rounded down to the next whole number. In this case, 3 results as the first value. Therefore, three banknotes 13 are removed from first money cassette 12*a*. Let them be one 100 euro and two 200 euro notes, making 500 euros. The 500 euros are subtracted from the requested sum of 1,875 euros, leaving a remainder of 1,375 euros. By subsequent division of this remainder by 500 and rounding off the result obtained, the next value obtained is 2. Accordingly, two banknotes 13 are removed from first money cassette 12*a*. Let these banknotes 13 be one 500 euro and one 100 euro, making 600 euros. Subtracting 600 euros from the 1,375 euros, the remainder is 775 euros.

By dividing this remainder by 500 euros and then rounding off the result obtained, we arrive at the value 1. Accordingly, a further banknote 13 is removed from the first money cassette. Let this be a 100 euro note. The 100 euros are subtracted from the 775 euros, so that 665 euros remain. By dividing again by 500 euros and rounding off the result obtained, we again obtain the value 1, so that a further banknote is removed from the first money cassette 12*a*. Let this next banknote 13 be a 200 euro note. By subtracting the 200 euros from the remainder 675, a remainder of 475 euros is obtained. Dividing the 475 euros by 500 euros and subsequently rounding off the result obtained to the next whole number gives 0. So no further banknote 13 can be taken from first money cassette 12*a* since the next banknote 13 removed from the first money cassette could be a 500 euro note and thus the requested amount to be dispensed would be exceeded. Since only 50 euro banknotes are disposed in second money cassette 12*b*, the remainder of 475 euros is divided by 50 euros and the result obtained rounded off to the next whole number. Accordingly, nine 50 euro notes are removed from the second money cassette.

Thus a remainder of 25 euros is left. Since both 10 euro and 20 euro notes are contained in third money cassette 12*c*, one banknote 13 is initially removed from the third money cassette. Let this banknote 13 be a 10 euro note. Subtracting the euros from the 25 euros gives a remainder of 15 euros. Since both banknotes 13 with a face value of 10 euros and banknotes 13 with a face value of 20 euros are stored in the third money cassette 12*c*, no further banknotes 13 can be removed from third money cassette 12*c*. Since there are only 5 euro banknotes in fourth money cassette 12*d*, three 5 euro notes are removed from fourth money cassette 12*d*. The resulting remainder is 0 euros. In sum, for the disbursal of the requested sum of 1,875 euros a denomination mix results of one 500 euro note, three 200 euro notes, three 100 euro notes, nine 50 euro notes, one 10 euro note and three 5 euro notes.

The invention claimed is:

1. A method for handling at least banknotes of a first denomination and banknotes of a second denomination, in which during a deposit transaction the banknotes to be deposited are deposited by way of an input-and-output unit, the genuineness of the deposited banknotes is verified with the aid of a reading unit and the denomination of the banknotes deposited is ascertained by the reading unit, and in which the banknotes deposited are taken to banknote acceptors, said method comprising:

stacking banknotes of the first denomination as well as the second denomination in one acceptor in a stack;

providing at least one memory element for each banknote acceptor in which at least data are stored with information about the denomination ascertained by the reading unit of all banknotes in the respective banknote acceptor and data are stored with information about the sequence in which the banknotes are disposed in the banknote acceptor and/or in a dispensing transaction banknotes to be dispensed are removed from the stack in at least one banknote acceptor and dispensed as a bundle to an operator with the aid of the input-and-output unit, determining the removal of banknotes to be dispensed from the banknote acceptors at least as a function of the data stored on the memory elements with information about the denominations of all banknotes accepted in the respective banknote acceptor and with information about the sequence in which the banknotes are disposed in the banknote acceptors.

2. The method of claim 1, wherein banknotes of a maximum of two different denominations are accepted in each banknote acceptor.

3. The method of claim 1, wherein the denomination of each banknote to be dispensed is ascertained by the reading unit when a banknote is withdrawn from an acceptor and this ascertained denomination is compared with a target denomination ascertained with the aid of the data stored on the memory element of the banknote acceptor from which the banknote to be dispensed was removed, and wherein the banknote is only dispensed if the ascertained denomination and the target denomination are identical.

4. The method of claim 1, wherein, as part of the dispensing transaction, banknotes that are not to be dispensed and that are disposed in a banknote acceptor in front of a banknote to be dispensed in the sequence in which the banknotes have to be removed from the bank acceptor are transported into interim storage, the banknote to be dispensed is removed, and the banknotes transported into interim storage are then transported into the banknote acceptor.

5. The method of claim 1, wherein banknotes to be taken to the banknote acceptors are assigned to the individual banknote acceptors at least as a function of the respective denomination of the banknote to be taken, of the predetermined denominations of banknotes assigned to each banknote acceptor that can be accepted in the banknote acceptor, of the denominations of the banknotes already accepted in the respective banknote acceptors and/or the sequence in which the banknotes are disposed in the banknote acceptors and wherein the banknotes are taken to the respectively assigned banknote acceptor.

6. The method of claim 1, wherein it is established as part of the dispensing transaction which banknotes are to be taken from the banknote acceptor before the first banknote of a bundle is removed from one of the banknote acceptors.

7. The method of claim 6, wherein at least two banknotes from the bundle to be dispensed that are located in different banknote acceptors are removed simultaneously from the banknote acceptors.

8. A method for handling banknotes in a machine, the banknotes being of different denominations including a first denomination and a second denomination, said method comprising:

using a reading unit to determine the denomination of banknotes deposited by a user into the machine;

providing a plurality of acceptors for accepting banknotes, each acceptor having its own memory element carried by the acceptor;

stacking banknotes of the first denomination as well as the second denomination in one acceptor in a stack;

storing in the memory element of said one acceptor information about the denomination and sequence of banknotes stored in the acceptor; and dispensing banknotes from the stack of at least said one acceptor as a function of the denomination and sequence information stored in the memory elements of the acceptors.

9. The method of claim 8 which further comprises:

providing an interim storage container for banknotes;

determining, prior to dispensing a banknote from said one acceptor, that a banknote to be dispensed is stacked behind another banknote of a different denomination that is not to be dispensed;

removing the banknote that is not to be dispensed from said acceptor and transporting it from the acceptor to the interim storage container;

removing the banknote to be dispensed from the stack and transporting it to an output for dispensing it to an operator of the machine; and returning the banknote that is not to be dispensed from the interim storage container to said acceptor.

10. The method of claim 9 wherein:

said one acceptor has an opening;

banknotes are fed through the opening with a stacker to stack banknotes of different denominates in the acceptor; and a banknote on the stack nearest the opening is removed by a singulator.

11. The method of claim 10 which further comprises:

providing at least a second acceptor;

stacking banknotes having a single and lesser denomination than banknotes in said acceptor in the second acceptor.

12. The method of claim 8 which further comprises:

exchanging an acceptor previously used in one machine by removing it from the one machine and mounting it in another machine, with the information stored in the memory element of the acceptor being used during operation of the other machine.

* * * * *